United States Patent [19]

Marchesini

[11] Patent Number: 4,566,731

[45] Date of Patent: Jan. 28, 1986

[54] DISMOUNTABLE FOLDING CHAIR

[75] Inventor: Sisto Marchesini, Vicenza, Italy

[73] Assignee: Royal Plastic S.A., Riva San Vitale, Switzerland

[21] Appl. No.: 613,282

[22] Filed: May 24, 1984

[30] Foreign Application Priority Data

May 27, 1983 [IT] Italy ..... 21337 A/83

[51] Int. Cl.[4] ..... A47C 4/28

[52] U.S. Cl. ..... 297/45; 297/441

[58] Field of Search ..... 297/440, 441, 46, 45; 16/87.2; 24/297, 622, 621, 16 PB

[56] References Cited

U.S. PATENT DOCUMENTS

| | | | |
|---|---|---|---|
| 2,837,142 | 6/1958 | McGuire | 297/441 X |
| 2,990,007 | 6/1961 | Kessler | 297/440 X |
| 3,253,860 | 5/1966 | Shapiro | 297/440 |
| 3,406,431 | 10/1968 | Armstrong et al. | 24/297 X |
| 3,663,055 | 5/1972 | Gale | 297/283 |
| 3,730,584 | 5/1973 | Uchida | 297/45 |
| 3,863,698 | 2/1975 | Uchida | 160/327 |

FOREIGN PATENT DOCUMENTS

| | | | |
|---|---|---|---|
| 513265 | 8/1952 | Belgium | 297/45 |
| 1431605 | 1/1966 | France . | |
| 436701 | 6/1948 | Italy | 297/45 |

*Primary Examiner*—James T. McCall

*Attorney, Agent, or Firm*—Fleit, Jacobson, Cohn & Price

[57] ABSTRACT

The invention concerns a dismountable folding chair or armchair structure, and in particular, a "director"-type chair, in which a fold-up seat, defined by pivoted elements, crossing one another, is hinged to side frames defining the supporting legs, the armrests and backrest elements of the chair.

The folding seat and the side frames include reciprocal connecting means which may snap on and off, to stiffen and hold the chair folded down. The seat and backrest fabrics, moreover, are removably fitted in order to allow the fabrics themselves to be changed.

8 Claims, 8 Drawing Figures

DISMOUNTABLE FOLDING CHAIR

BACKGROUND OF THE INVENTION

This invention refers to a "director"-type folding chair structure, that is to say, a chair or armchair comprising a folding seat made up of pivoted elements to which a fabric is secured, which elements are hinged to side frames defining the supporting legs, the armrests and, respectively, upright elements supporting the backrest fabric.

In folding chairs of the aforementioned type, the elements of the folding seat, also referred to as articulated cross elements, besides being pivoted to each other and hinged to the supporting legs of the chair, in correspondence with their lower ends, are also connected, at the front and the back, to the side frames by means of short connecting rods or links designed to keep the supporting legs to the sides, whilst allowing the rotation of the cross elements of the seat, in order to fold up the chair itself. Usually, in folding chairs of the type in question, the pivoting and hinging between the parts which make up the chair itself are the weakest points and those subjected to greatest stress and are therefore the cause of possible breaking or faulty functioning of the chair; moreover, such chair structures are not sufficiently stable or stiffened, as the hinges tend to wear out and no longer allow a rigid connection between the seat and the lateral legs. The chair may therefore prove to be rather unsteady and in time may break and become totally unserviceable.

In folding chairs of the known type moreover, it occurs that, once assembled, the various parts are permanently connected together and the chair, or parts thereof, can no longer be diassembled. A scope of this invention is to provide a folding chair of the type previously described, which is capable of overcoming the above-mentioned problems and, in particular, concerns a chair provided with connecting means between the cross elements of the seat and the legs of the side frames, which are capable of giving the chair structure a high degree of rigidity or stiffening and stability, when open or folded down.

A further scope of this invention is to provide a folding chair, as described, provided with special snap-fastening means between the cross-elements of the seat and lateral legs, to allow the shipment of the chair in its fully disassembled condition, and its quick assembling, with the possibility of replacing the seat and/or backrest fabrics at any time without totally disassembling the chair.

A still further scope of this invention is to provide a folding chair structure, as described, which is highly simplified due to the elimination of connecting rods between the cross-elements of the seat and side frames, quick and easy to assemble and, finally, relatively inexpensive to manufacture.

SUMMARY OF THE INVENTION

The chair according to this invention, of the type comprising a folding seat frame provided with front and rear articulated cross elements, the lower ends of which are pivoted to side frames defining the supporting legs, the armrests and the uprights of the backrest of the chair, is characterized by the fact that said side frames and the folding seat frame, in correspondence with the upper ends, are provided with reciprocal snap-on connecting means, which engage and disengage with each other, and by the fact that said connecting means present shouldering surfaces to stiffen the seat frame to side frames, which are arranged both in a longitudinal and a crosswise plane of the chair itself.

According to a particular embodiment of the chair, the seat fabric is held by lateral supporting rods which snap into fork-shaped ends of the cross-element of the seat frame, so as to permit the disassembling and removal and/or displacement of the fabric itself. According to this embodiment, the snap-on connecting means between the seat frame and side legs, comprises an enlarged head at each end of said supporting rods, which snaps into a hooking seat provided on the internal side of the respective leg.

BRIEF DESCRIPTION OF THE DRAWINGS

These and other features of the folding chair or armchair according to this invention, will ensure from the following description, with reference to the accompanying drawings, in which.

DESCRIPTION OF THE INVENTION

Figure 1:
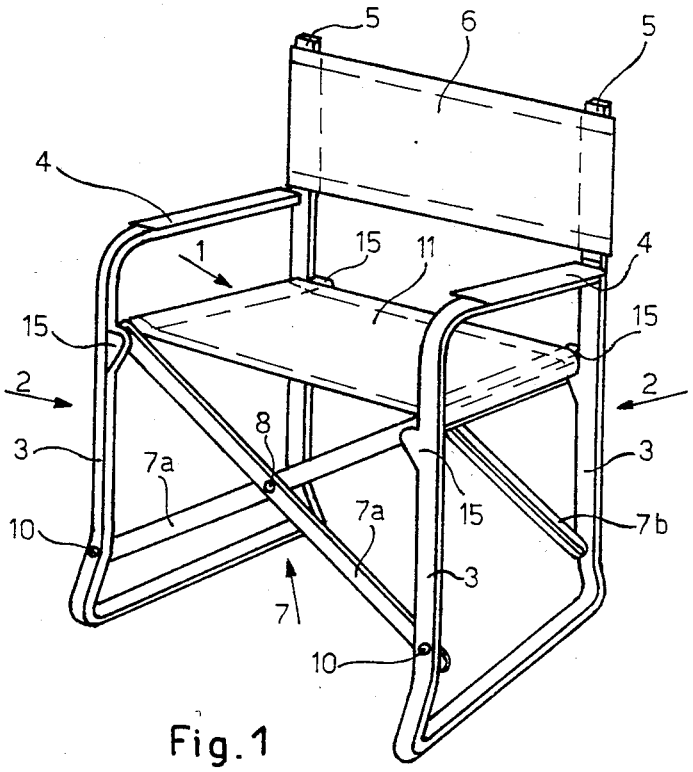
FIG. 1 shows a perspective view of the folding chair.
Figure 2:
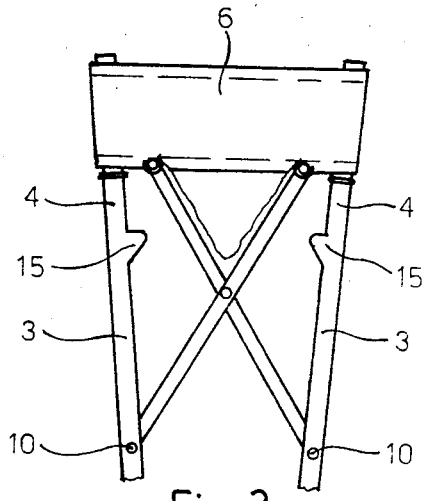
FIG. 2 shows a front view of the partially closed chair.

As shown in the figures, the chair substantially comprises a seat 1 having a folding frame supported by side frames 2, defining the chair legs 3, the armrests 4 and the uprights 5 supporting a fabric for the backrest 6.

Figure 3:
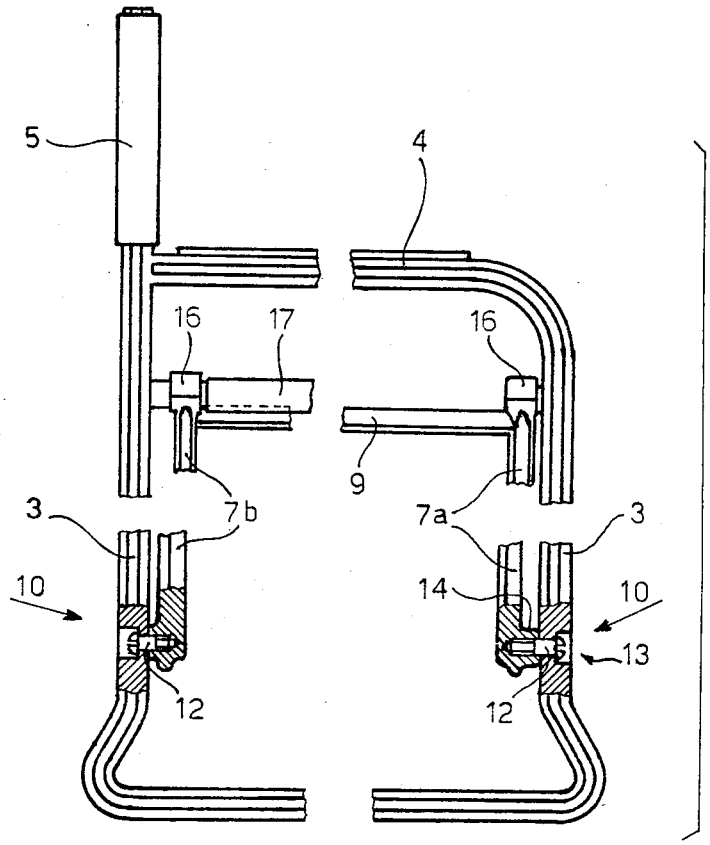
FIG. 3 shows a side view of the chair structure, with parts removed and parts shown in section.
Figure 7:
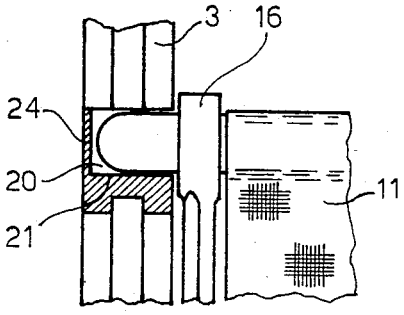
FIG. 7 shows a cross-sectional view along line 7—7 of FIG. 6.

As shown in the figures, the folding frame of the seat 1 consists of cross-elements 7, pivoted at 8, situated both to the front and to the rear of the chair, in which each front rod **7*a* is rigidly connected to corresponding rear rod 7*b* by means of a cross bar 9 which joins them close to their upper ends (FIG. 3). The lower ends of the rods 7*a* and 7*b* of each cross element 7 are pivoted at 10 to the side legs 3 of the chair, as shown for example in the enlarged cross-sectional view in FIG. 3. Lastly, reference 11 indicates the fabric of the seat 1, which is suitably secured to the cross elements 7**, as explained further on.

Figure 8:
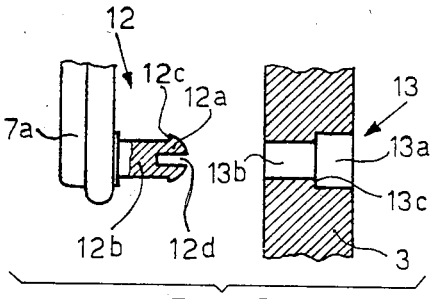
FIG. 8 shows a detail of FIG. 3.

FIGS. 3 and 8 show the detail of each joint 8 and 10, designed to permit a snap-on connection between the rods **7*a*, 7*b* of the cross elements 7 and the chair legs 3. This joint comprises a threaded pin 12, screwed for example into the lower end of a rod 7*a*, 7*b*, said pin 12 presenting a shank 12*b* and a head 12*a* which snaps into a shouldered hole 13 in the leg 3 having a hole portion 13*b* of the same diameter as shank 12*b* and an enlarged portion 13*a*. The snap-fastening head 12*a* is elastically yielding, thanks to a notch 12*d* which extends over the entire head and beyond the flat retaining surface 12*c* with which the head 12*a* is provided on the side of the shank 12*b*, and which is designed to engage with a similar retaining surface or annular shoulder 13*c* inside the enlarged hole portion 13***a*, designed to receive the head 12*a* of the pin. The head 12*a* is suitably rounded, so that when it is placed against the part 13*b* of the hole 13, and forced in, it contracts elastically to pass through said hole portion 13*b* and then snaps into the hole portion 13*a*. The flat retaining surfaces or shoulders 12*c* and 13*c*, at right angles to the axis of the pin 12 and the hole 13, subsequently prevent the pin from sliding out. In this way, it is possible to ship and/or sell the chair completely disassembled, assembling the same later without the need for any tools whatsoever.

As mentioned previously, the chair comprises reciprocal connecting means between the frame of the seat 1 and, respectively, the legs 3 of the chair, in correspondence with the upper ends of the rods 7*a* and 7*b;* these connecting means are of the type which engage and disengage by a snap-fastening action and join said parts securely, in order to prevent any relative lengthwise or crosswise movements of the seat 1; in this way, the chair is given high degree of stability and structural rigidity or stiffening when folded down, without using supplementary linkages as occurs in chairs of the known type. These connecting means have been indicated in the figures, all together, by 15.

Figure 4:
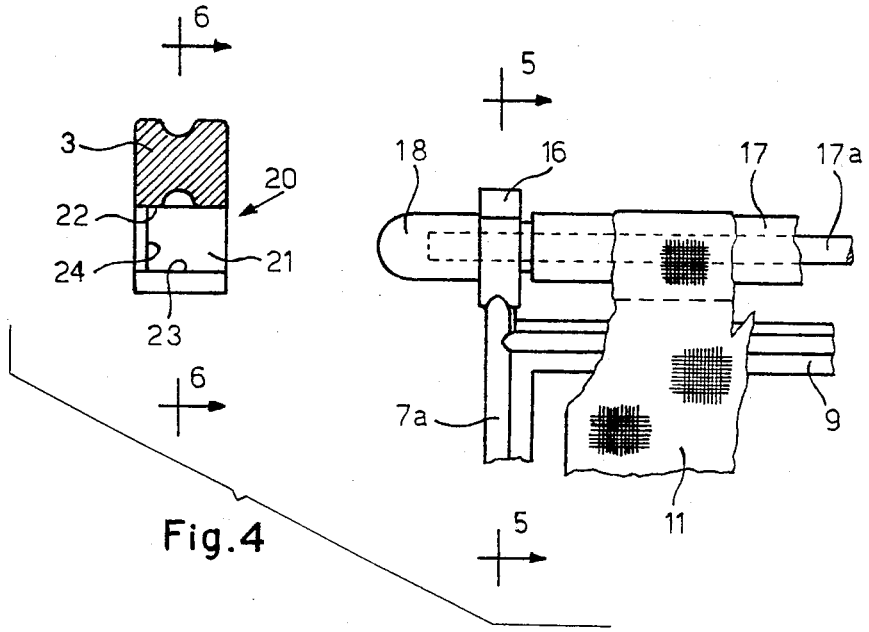
FIG. 4 shows an enlarged detail of the fastening means between the folding seat frame and the side legs of the chair.
Figure 5:
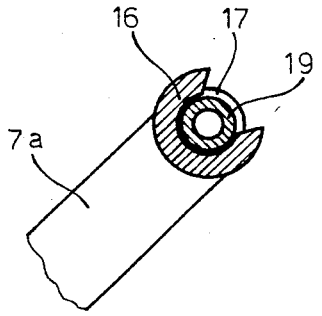
FIG. 5 shows a cross-sectional view along line 5—5 of FIG. 4.
Figure 6:
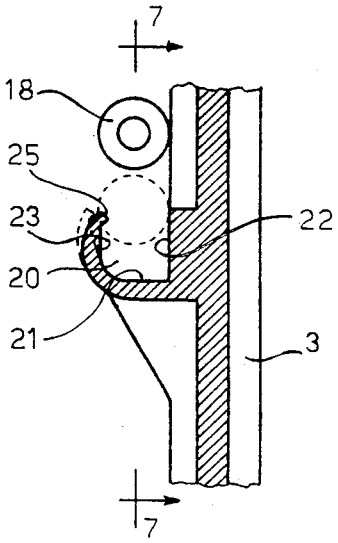
FIG. 6 shows a cross-sectional view along line 6—6 of FIG. 4.

As shown in the figures from 3 to 7, the upper end of each rod 7*a* and 7*b* of the cross elements 7 is provided with a fork-shaped portion 16 into which snaps a rod 17 supporting the seat fabric 11; the rod 17 is arranged parallel to the cross bar 9 joining two corresponding rods 7*a* and 7*b* of the two cross elements 7. In this way, it is possible to apply and remove the fabric 11 of the seat 1 at any moment by simply disengaging the two rods 17 from the rods 7*a*, 7*b*, sliding out and replacing the fabric 11 suitably prepared with its side edges folded and stitched, as shown schematically in FIG. 4.

In particular, in the case in which the entire structure of the chair is made of plastic material, each rod 17 may comprise a metal stiffening core 17*a;* moreover, each end of the rod presents a rounded head 18 joined to the body of the rod by means of a narrowed portion or neck 19 which snaps into the aforesaid fork portion 16. The fork 16 consists of two elastically yielding arched arms whose internal diameter adapts to the external diameter of the neck portion 19 of the rods 17, whilst the opposite edges of the arched arms of the fork are delimited by flat converging surfaces, which define an aperture which narrows inwards and which is smaller than the diameter of the neck portion 19. Consequently, by exploiting both the elasticity of the material used, it is possible to snap the rods 17 of the seat into, and out of the forks 16 of the cross-elements 7.

As mentioned previously, each end of the rods 17 of the folding seat comprises a rounded head 18, forming part of the snap-fastening means between the folding seat 1 and the side legs 3. In the embodiment shown, such snap fastening means comprise a seat 20 on the inner side of each leg 3, designed to retain the respective head 18 of the rods 17. The seat 20 is delimited by a base wall 21, by two lateral walls 22 and 23, arranged in a longitudinal direction to the chair, that is, parallel to the main plane of frame 2, and by a transversal end wall 24 on the front and, respectively, rear side of the chair, so as to define shouldering surfaces for the rods 17 which act upon the heads 18 in both a longitudinal and transversal direction, thereby achieving a stiffening connection between the seat 1 and legs 3 of the folding chair.

The head 18 of each rod is held in the seat 20 by means of a snap action defined by an upper edge 25 protruding towards the inside of the seat 20 on the wall 23 opposite the leg 3. As the width of the seat 20 corresponds substantially to the width of the head 18, the latter may snap in easily due to the elastically yieldable wall 23, obtained by forcing the head 18 downwards; it is obvious that the disengagement of the parts occurs in reverse order to that described.

The solution previously described and illustrated in the various figures proves to be extremely advantageous in that it allows the chair to be shipped fully disassembled and later assembled by means of the snap connections and pins described; moreover, it permits the removal and replacement of the backrest and seat fabric whenever required, by simply sliding them off after having unhooked the lateral rods 17 of the seat. A folding chair structure is thus obtained, which can be sent disassembled, is extremely compact, quick and easy to assemble even by the purchaser himself, and which offers excellent stability and rigidity when folded down, thanks to the special snap connections between the seat and lateral legs. It is obvious that what has been described and shown was given merely by way of example and that the chair may be made of any suitable material whatsoever, and with a different shape and arrangement of the parts constituting the snap connections without thereby deviating from the inventive principle claimed herein.

What is claimed is:

1. A folding chair comprising:

two side frames, each side frame including interconnected front and rear legs, an armrest, and upright portions for supporting a backrest;

four elongated members, two of said four elongated members each being pivotably mounted at one end to a different one of said front legs and the other two of said four elongated members each being pivotably mounted at one end to a different one of said rear legs, said two elongated members crossing over one another and said other two elongated members crossing over one another, the other end of said four elongated members including a first connecting means, said first connecting means having a fork-shape portion;

second connecting means defined by each of said front legs and each of said rear legs, said second connecting means having a fork-shaped portion; and two side bars, each side bar interconnecting the second connecting means of one rear leg with the second connecting means of an opposed front leg and portions of each of said side bars having a diameter greater than the distance between the ends of the tongs of said fork-shape portion of said second connecting means for releasably holding said side bar within said second connecting means and other portions of each of said side bars having a diameter greater than the distance between the end of the tongs of said fork-shape portion of said first connecting means for releasably holding said side bars within said first connecting means when said side bars are releasably held by said second connecting means.

2. A folding chair comprising:

two side frames, each side frame including interconnected front and rear legs, an armrest, and upright portions for supporting a backrest;

cross members, two of said cross members each being pivotably mounted at one end to a different one of said front legs and two other cross members each being pivotably mounted at one end to a different one of said rear legs, said two cross members crossing over one another and being pivotably connected to each other at their cross over location, said other two cross members crossing over one another and being pivotably connected to each other at their cross over location;

side bars for supporting a seat;

first connecting means defined by the other ends of said cross members and said side bars for connecting, by a snap action, the side bars to the other ends of said cross members and to prevent accidental disengagement of said side bars from said cross members while allowing removal of said side bars from said cross members for replacing and cleaning said seat; and second connecting means defined by said side bars and said legs to firmly connect and disconnect said side bars to said legs by a snap action and to prevent accidental disengagement of said side bars from said legs.

3. A chair as claimed in claim 2, wherein said cross members include fork-shaped and elastically yielding upper ends, and said side bars supporting the seat engage said cross members by snapping removably into the fork-shaped ends of the cross members.

4. A chair as claimed in claim 2, wherein said second connecting means comprise a connecting head at each end of said side bars and a respective seating on one side of each chair leg, said seating being delimited by an end surface, by opposing lateral surfaces and by a transversal surface facing the aforesaid head, one of said lateral surfaces having its upper edge slightly protruding inwards.

5. A chair as claimed in claim 2, in which said cross-members are hinged to the side frames by means of threaded pins, screwed into the cross-members themselves.

6. A chair as claimed in claim 5, in which said pins present an elastically deformable head, designed to snap into a shouldered hole in a respective leg of the chair.

7. A chair as claimed in claim 6, in which said pin head and said shouldered hold present flat retaining surfaces arranged at right angles to the axis of the pin and to the hole itself.

8. A chair as claimed in claim 3, in which said fork ends comprise arched arms, the opposing ends of which are delimited by flat converging surfaces.

* * * * *